US005848515A

United States Patent [19]

Catelli et al.

[11] Patent Number: 5,848,515

[45] Date of Patent: Dec. 15, 1998

[54] CONTINUOUS-CYCLE STERILE BOTTLING PLANT

[75] Inventors: Camillo Catelli, Parma; Leo Bonetti, Reggio Emilia, both of Italy

[73] Assignee: Rossi & Catelli S.P.A., Parma, Italy

[21] Appl. No.: 767,628

[22] Filed: Dec. 17, 1996

[51] Int. Cl.[6] ..... B65B 55/00

[52] U.S. Cl. ..... 53/167; 53/281; 141/85; 141/92; 141/147; 141/150

[58] Field of Search ..... 53/167, 281, 426; 141/85, 90, 91, 92, 147, 148, 150

[56] References Cited

U.S. PATENT DOCUMENTS

| | | | |
|---|---|---|---|
| 2,801,650 | 8/1957 | Breeback | 141/148 X |
| 3,335,767 | 8/1967 | Manas | 141/147 |
| 3,481,109 | 12/1969 | Pavey | 141/85 X |
| 4,208,852 | 6/1980 | Pioch | 53/167 |
| 4,495,974 | 1/1985 | Pohorski | 141/85 X |
| 4,508,148 | 4/1985 | Trechsel et al. | 141/147 |
| 4,693,052 | 9/1987 | Rebmann et al. | 53/167 |
| 4,707,334 | 11/1987 | Gerhard | 53/167 X |
| 4,721,138 | 1/1988 | Simonazzi | 141/150 |
| 4,734,268 | 3/1988 | Redding et al. | 53/167 X |
| 4,979,347 | 12/1990 | Shibauchi et al. | 53/167 |
| 5,053,196 | 10/1991 | Ide et al. | 53/167 X |
| 5,125,440 | 6/1992 | Mette | 141/147 X |
| 5,163,487 | 11/1992 | Clusserath | 141/92 |
| 5,219,405 | 6/1993 | Weiss | 141/150 X |
| 5,406,772 | 4/1995 | Dinius | 53/167 X |
| 5,673,535 | 10/1997 | Jagger | 53/167 X |

FOREIGN PATENT DOCUMENTS

| | | |
|---|---|---|
| 0 518 828 A1 | 12/1992 | European Pat. Off. . |
| 43 43 425 A1 | 6/1995 | Germany . |
| 1 488 428 | 10/1977 | United Kingdom . |
| 2 280 669 | 2/1995 | United Kingdom . |
| WO 93/04975 | 3/1993 | WIPO . |

*Primary Examiner*—Daniel B. Moon
*Attorney, Agent, or Firm*—Flehr Hohbach Test Albritton & Herbert LLP

[57] ABSTRACT

A bottling plant is described wherein a bottle feed line and a plurality of specific function groups are each provided with selectively operable devices acting on the bottles moving along the feed line. Each special function group includes one or more motors for actuating the selectively operable devices and a walled sterile chamber through which the bottles pass. The sterile chambers are kept slightly pressurized and contain at least a portion of the selectively operable devices of the specific function group. The wall structure of each sterile chamber separates the sterile chamber from the motors and from at least some of the selectively operable devices.

11 Claims, 4 Drawing Sheets

CONTINUOUS-CYCLE STERILE BOTTLING PLANT

CROSS REFERENCE TO RELATED PATENT APPLICATION

The bottling plant described and claimed herein includes a device for tilting bottles upside down and/or right side up. The preferred type of such a device is described in detail in a patent application entitled Apparatus for Upending and Transporting Bottles in Continuous Cycle Ser. No. 08/767,629, filed concurrently herewith by the same applicant and naming the same inventors as this application. The contents of the concurrently filed application are incorporated herein for reference purposes.

BACKGROUND OF THE INVENTION

The invention relates to a continuous-cycle sterile bottling plant. The plant in question is mainly used with plastic bottles, with special application to bottles made of PET (polyethylene terephthalate). This type of bottling plant is already well known, and includes several successively positioned groups of operating equipment, each performing a specific function on the bottles as they transit along a feed line. In general these specific function groups include a sterilizing group, a washing group, a filler group and a capping group.

To guarantee sterile operating conditions, the whole plant is subjected to a slightly pressurized atmosphere. Operators, inside the plant itself, follow and check its operations. Obviously the operators wear special garb to prevent contamination of the sterile environment.

Each time the bottling plant is started-up, not only does the plant itself have to be completely and scrupulously sterilized both internally and externally; but the environment, that is the chamber housing the plant, must also be carefully sterilized. The external parts are cleaned with sterilizing fluids while the internal parts are subjected to a mock functioning cycle during which sterilizing fluid, instead of product, is circulated.

As during a normal plant cycle, the filler group heads are opened by the bottle necks and mouths. In order to complete a mock functioning cycle, dummy bottles are used to open the filler heads. The dummy bottles are hand loaded by one or more operators. This operation therefore involves considerable preparation time as a large number of dummy bottles must be loaded.

The main drawbacks exhibited by the known-types of bottling plants include, apart from the obvious irritation of the operators at having to wear special garb, the complexity and lengthiness of the sterilizing operations at machine start-up, and the difficulty and expense incurred at having to keep the environment (of considerable size) containing the plant in conditions of sterility.

Owing to these difficulties in known-type plants, in order not to introduce polluting elements which would quickly compromise the sterility of the environment, it is necessary to introduce bottles which are completely sterile, both inside and outside, into the sterile chamber.

SUMMARY OF THE INVENTION

The main object of the invention is to obviate the above-mentioned drawbacks in the prior art by providing a sterile bottling plant which is rapidly and easily sterilizable and which can be kept sterile in a sure but relatively simple and economic way.

An advantage of the invention is that it relieves operators of the need to wear protective garb. A further advantage is that non-sterile bottles can be used and can be stocked, prior to use, in normal ways.

A further aim of the invention is to provide a sterilizing method for the bottle filler group which is both simple and economical, as well as a filler group for use with said method.

The above objects and advantages as well as others are all achieved by the plant, by the filler group and by the method of the present invention, as it is characterized in the claims that follow.

BRIEF DESCRIPTION OF THE DRAWINGS

Further characteristics and advantages of the present invention will be better understood from the following detailed description of a preferred embodiment of the invention, illustrated in the form of a non-limiting example in the accompanying drawings, in which.

DESCRIPTION OF THE PREFERRED EMBODIMENTS

Figure 1:
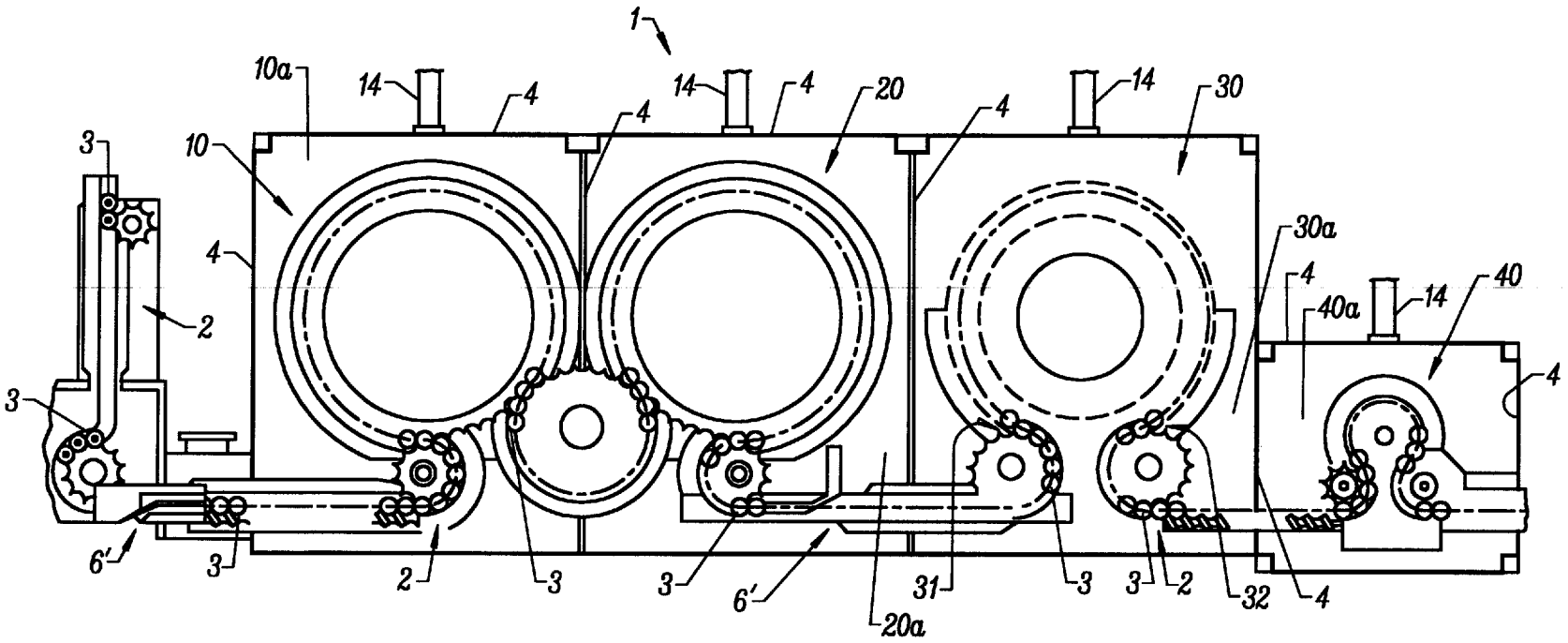
FIG. 1 is a top schematic plan view of a plant in accordance with the invention.

With reference to the drawings, there is shown, in FIG. 1, a continuous-cycle sterile bottling plant 1, in accordance with the invention, which includes a feed line 2 of bottles 3. The bottles 3 are fed one after another sequentially to different specific function groups 10, 20, 30, 40. Each such specific function group is provided with selectively operable devices for performing that group's specific functions on the transiting bottles 3. Further, each specific function group is provided with motorization for moving the bottles 3 as well as means for activating the selectively operable devices.

Figure 2:
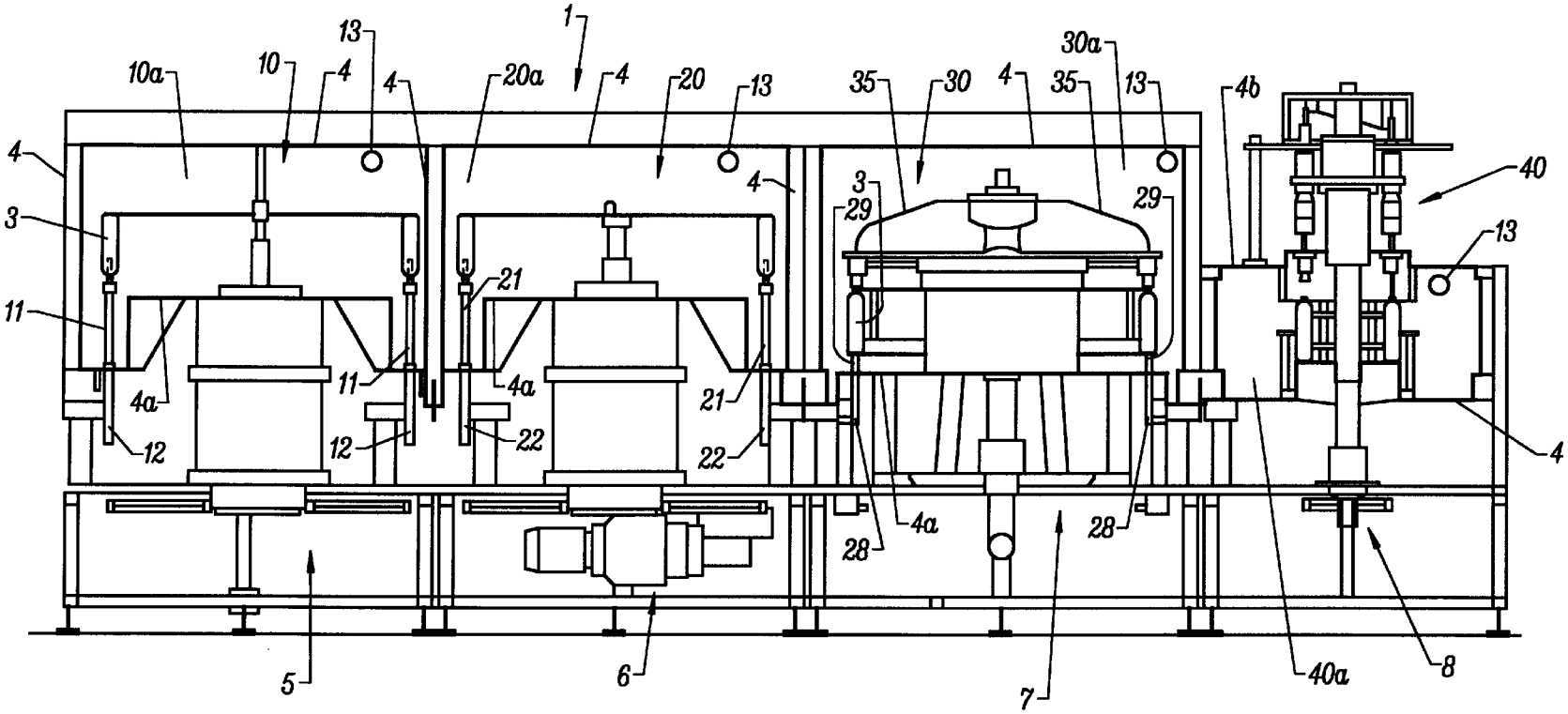
FIG. 2 is an elevational schematic view of the plant shown in FIG. 1.
Figure 3:
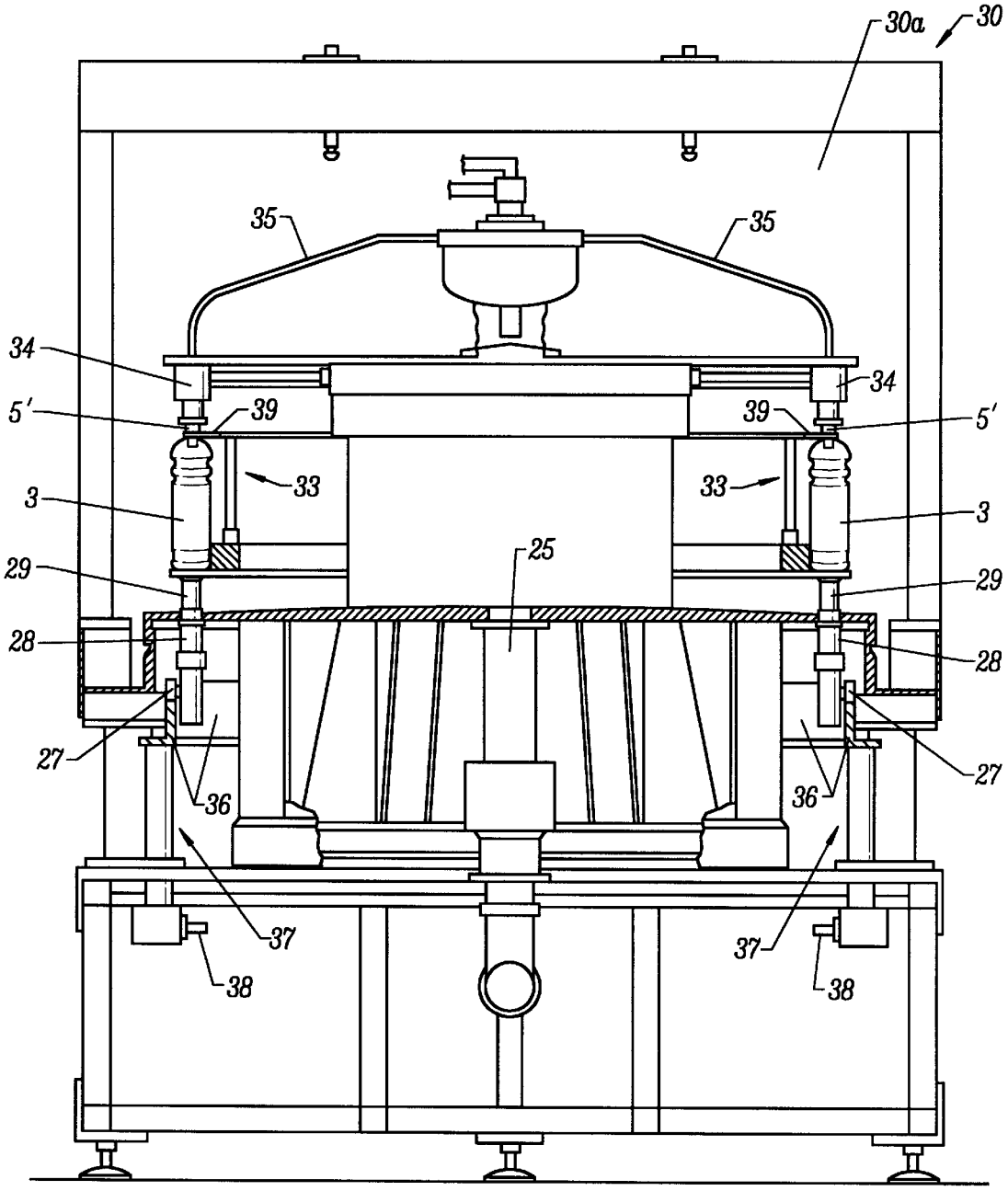
FIG. 3 is a detailed elevational view, in enlarged scale, of the filler group portion of the plant shown in FIGS. 1 and 2.
Figure 4:
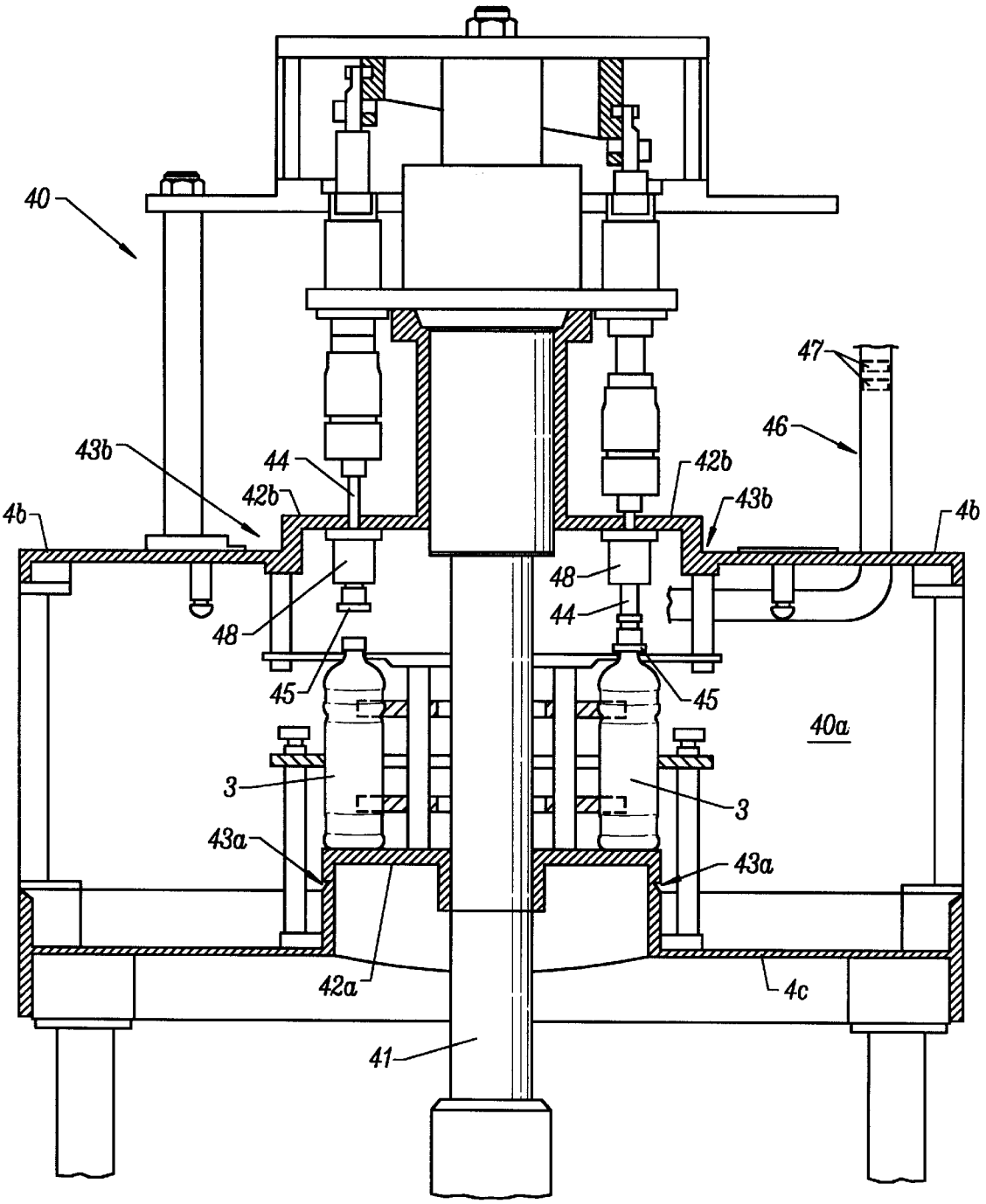
FIG. 4 is a detailed elevational view, in enlarged scale, of the capping group portion of the plant shown in FIGS. 1 and 2.

In the embodiment shown, the plant 1 comprises a sterilizing group 10, a washing group 20, a filler group 30 and a capping group 40. Motors 5, 6, 7 and 8 (shown in FIG. 2) of known type, are provided for each group 10, 20, 30 and 40, respectively. Two tilting devices 6' (preferably of the type described in copending application entitled "Apparatus for Upending and Transporting Bottles in Continuous Cycle" Ser. No. 08/767,629 filed concurrently herewith by applicant) are provided for tilting the bottles 3. Most of the selectively operable devices of the various specific function groups are also of known type and include vertical pipes 11 in group 10 and 21 in group 20; and vertical shafts 29 in group 30 and 44 in group 40 (see FIGS. 2, 3 and 4). All of the above mentioned selectively operable devices are disposed to rotate within their respective function group along with the bottles 3. The vertical pipes 11 are provided for passage of the sterilizing liquid and vertical pipes 21 are provided for passage of the washing fluid. Each pipe 11 and 21 is vertically slidable with respect to its respective hub 12 and 22 each of which includes a sterile barrier. The upper end of each pipe 11 and 21 carries a nozzle which can be inserted into a bottle, and through which the relative sterilizing or washing fluid is sprayed into the bottle.

Each specific function group includes a sterile chamber 10*a*, 20*a*, 30*a*, 40*a*, respectively, through which the bottles 3 pass. Each sterile chamber is enclosed by a wall structure 4; is kept slightly pressurized; and contains part of the equipment of the respective specific function group. The wall structure 4 of each sterile chamber isolates it from the motor used for the movement of the bottles 3 and the means for activating the selectively operable devices in their respective specific function group. The motors and the activation devices are thus outside the sterile chamber. A part of each wall structure 4 includes a portion 4*a* which rotates with the bottles.

The various sterile chambers for each specific function group are interconnected. All of the chambers are provided with an independent inlet 13 and outlet 14 for sterile fluid which keeps the relative chamber sterile and above normal pressure. However, the chamber 10*a* of the sterilizing group 10 is kept at a pressure slightly lower than that of the other sterile chambers but still higher than the pressure outside the chambers.

Each of the outlets 14 is provided with a valve or some other means of selectively restricting flow therethrough. The valved outlets are ideally placed in communication with the outside environment by way of scrubbers, not shown. The outlet 14 of the sterile chamber 10*a* of the sterilizing group 10 is normally in communication with the external atmosphere during operation. The outlets 14 of the other specific function groups are normally closed during operation. Further, for reasons that will become clear hereinafter, the outlet 14 of the sterilizing group 10 can also be closed in case of necessity.

The filler group 30 (FIGS. 1, 2 and 3), like the other groups, is rotary. It includes an entrance 31 and an exit 32 for the bottles 3. The filler group 30 is further provided with a vertically disposed rotating shaft 25 which rotates a plurality of support assemblies 33 with it. Upon rotation of the shaft 25, each of the support assemblies 33 transports bottles 3 from the entrance 31 to the exit 32. Each support assembly 33 is selectively movable up or down. A filler head 34 is associated with each support assembly 33, and is connected to a means for dispensing the product destined to fill the bottles 3. The means for dispensing includes a plurality of product dispensing pipes 35.

Each filler head 34 opens and dispenses the product, upon the application of an upward force thereon. An annular cam 36, disposed below the path of the bottles, acts on the support assembly 33, upon rotation of the latter, to cause vertical displacements thereof. The cam 36 actuates a plurality of vertical shafts 29, one for each support assembly 33, to slide vertically in a hub 28 which includes a sterile barrier. Shortly after the entrance 31, the cam 36 urges the shafts 29 upwardly and, shortly before the exit 32, it urges them downwardly. The top of each shaft 29 is fixed to a respective support assembly 33 and the bottom of each shaft 29 is coupled with the cam 36 by means of a follower wheel 27.

Further, fixed on top of each support assembly 33, is a filler head actuating element 39 arranged such as to exert, on the respective filler head 34, an upward force sufficient to cause the filler head 34 to open. The filler head actuating element 39 is preferably forked, and a bottle neck 5' of a bottle to be filled is held within the fork. The cam 36 acts on the support assemblies 33 and consequently on the filler head actuating element 39 providing interaction, through the necks of the bottles, with the respective filler head 34, opening same.

Lifters 37 are provided for selectively raising or lowering the cam 36 by a distance corresponding to the height of the bottle necks so that the filler head actuating elements 39 can operate directly on the filler head to open it for sterilizing the filler heads when bottles are not in the feed line. Such an arrangement also allows for the adaption of the filler to bottles having different heights. The lifters 37 are arranged below the cam 36 externally of the sterile chamber 30*a*. Each lifter 37 is provided with a vertical-axis rack and an activating mechanism, not illustrated. The mechanism can be operated by hand merely by using a gripping device or crank 38. The upper end of the rack presses on the base of the cam 36 to be lifted.

The capping group 40 (FIGS. 1, 2 and 4) includes a vertical central drive shaft 41 and discs 42*a* and 42*b* fixed coaxially to the drive shaft 41. A seal 43*b* is provided between the disc 42*b* and the upper wall 4*b* of the sterile chamber 40*a*. A slight gap 43*a* is provided between the periphery of the disc 42*a* and the lower wall 4*c*. The higher pressure of the atmosphere inside the chamber 40*a* causes some of the sterile air in the chamber to pass to the outside through the gap 43*a* while the washing and sanitizing solutions drain to the bottom wall 4*c* of the capping group 40. Somewhat similar gap arrangements may be utilized in the other function groups 10, 20 and 30.

The capping group 40 further includes a plurality of rods 44 each being provided at its lower end with a chuck 45 for capping a respective bottle 3. Each rod 44 rotates with the drive shaft 41 and is selectively movable up and down through its respective hub 48 which includes a sterile barrier. The hub 48 is solidly mounted on the disc 42. Conventional means, not shown, are provided to rotate the chucks 45 on their own axis to provide a screw-on operation when using caps of that type. Such rotation of the chucks 45 is responsive to the rotary motion of the central drive shaft 41. The capping group 40 is further provided with a cap feed line 46 along which the caps 47 undergo a sterilization operation.

To sterilize the filler group 30, when it is restarted after a pause, the following procedure is observed. The filler heads 34 are supplied with a sterilization fluid. The cam 36 is raised sufficiently to raise the support assembly 33 and, consequently, the filler head actuating elements 39 to exert an upward force directly against the filler heads 34 sufficient to open them. The filler group is operated in this manner for the length of time necessary for sterilizing the dispensing pipes 35 through which, during normal functioning, the product to be bottled passes. The sterilization fluid flows into the chamber 30*a* and is collected at the bottom thereof. If necessary more than one sterilization and washing liquid can be dispensed. During the course of normal functioning of the filler group 30, the lifters 37 are brought into a lowered position so that the filler head actuating elements 39 do not directly interact with the filler heads 34.

The operators, staying outside the sterile chambers, can still gain easy access to the motor and the selectively operable devices of the plant without having to don protective garb.

Thanks to the fact that the sterile chamber 10*a* of the sterilizing group is kept at a slightly lower temperature, and thus a lower pressure, than the other sterile chambers, the likelihood of passage of gas from the sterilizing group chamber into the other chambers can be precluded. This prevents the sterilization fluids injected into the sterile chamber 10*a* from spreading into the adjacent chambers.

During normal functioning, the fluid keeping the various chambers sterile flows in a direction opposite that of the bottles, advancing toward the outlet 14 in the sterilizing group 10.

Should it for any reason become necessary to service the equipment inside one of the chambers, the outlet 14 in the sterilizing group 10 is closed; the supply of sterile fluid to the chambers adjacent the one being serviced is increased, and the chamber to be serviced is opened so as to enable an external operator to work inside. In this way the sterility of the other chambers is not compromised.

When the service operation is complete, the chamber is closed again and its outlet 14 to the outside environment is opened, so that the sterile fluid entering all of the other chambers pass toward and through the previously-opened chamber and exits from its outlet 14. This purging operation is continued until conditions of sterility have been re-established in the previously opened chamber. In general, given the relatively modest volume of the chambers, this phase will be very brief. The outlet 14 in the previously opened chamber can then be closed; the outlet 14 in the sterilizing group 10 can be reopened and normal operation can be resumed. It is obvious, then, that this plant offers considerable advantages with respect to the "sterile chambers" of the prior art in which operations of the above-described type are very much longer and more complex.

We claim:

1. A continuous-cycle sterile bottling plant, comprising:

a plurality of specific function groups, each of which is provided with selectively operable devices for performing its specific function on bottles and a motor for activating said operable devices;

a feed line of bottles passing through each of said plurality of specific function groups;

each of said plurality of specific function groups including a wall structure defining a sterile chamber; means for maintaining each of said sterile chambers slightly pressurized; and each of said sterile chambers containing at least a portion of the selectively operable devices for one of said specific functions;

each of said sterile chambers including an independent inlet of sterile fluid and a closable outlet to the environment, the closable outlet of the chamber most upstream with respect to said bottle feed line being normally open during operations, the closable outlets of the remaining chambers being normally closed during operations; and each of said wall structures separating its respective sterile zone from its respective motor.

2. A plant as defined in claim 1, wherein one of said specific function groups comprises a group for sterilizing bottles, the sterile chamber of said group for sterilizing bottles being maintained at a slightly lower pressure than said sterile chambers for other specific function groups.

3. A plant as defined in claim 2, wherein one of said specific function groups is a filler group comprising:

dispensing means for carrying a product destined to fill said bottles;

a plurality of bottle support devices selectively moveable vertically; a filler head connected to said dispensing means and disposed above each of said support devices; said filler head being opened for dispensing said product in response to an upwardly-directed force thereon;

cam means for urging said support devices vertically;

a filler head actuating element disposed on each of said support devices and configured to exert an upwardly-directed force on a respective filler head sufficient to cause opening thereof.

4. A plant as defined in claim 3, wherein said filler head actuating element is fork-shaped and adapted to receive the mouth of a bottle to be filled.

5. A plant as defined in claim 3, characterized in that said means for positioning comprise at least one lifter responsive to said cam means.

6. A plant as defined in claim 5, wherein said filler head actuating element is fork-shaped and adapted to receive the mouth of a bottle to be filled.

7. A plant as defined in claim 1, wherein one of said specific function groups is a filler group comprising:

dispensing means for carrying a product destined to fill said bottles;

a plurality of bottle support devices selectively moveable vertically; a filler head connected to said dispensing means and disposed above each of said support devices; said filler head being opened for dispensing said product in response to an upwardly-directed force thereon;

cam means for urging said support devices vertically;

a filler head actuating element disposed on each of said support devices and configured to exert an upwardly-directed force on a respective filler head sufficient to cause opening thereof.

8. A plant as defined in claim 7, wherein said filler head actuating element is fork-shaped and adapted to receive the mouth of a bottle to be filled.

9. A plant as defined in claim 7, characterized in that said means for positioning comprise at least one lifter responsive to said cam means.

10. A plant as defined in claim 9, wherein said filler head actuating element is fork-shaped and adapted to receive the mouth of a bottle to be filled.

11. A plant as in any of claims 1 through 10 wherein one of said special function groups is a capping group comprising:

a central vertical-axis drive shaft; a disc fixed coaxially to said drive shaft; and sealing means disposed between the periphery of said disc and said wall structure of said capping group;

a plurality of hubs, each having with a sterile barrier, mounted solidly to said disc;

a plurality of rods each being provided, at its lower end, with a chuck for capping a bottle and which is rotated in response to rotation of said drive shaft; each of said plurality of rods being selectively moveable in a vertical direction through one of said hubs.

* * * * *